US009997105B2

(12) United States Patent
Sun et al.

(10) Patent No.: US 9,997,105 B2
(45) Date of Patent: Jun. 12, 2018

(54) OLED PIXEL DRIVING CIRCUIT AND DRIVING METHOD AND OLED DISPLAY APPARATUS

(71) Applicant: BOE TECHNOLOGY GROUP CO., LTD., Beijing (CN)

(72) Inventors: Tuo Sun, Beijing (CN); Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 140 days.

(21) Appl. No.: 14/917,762

(22) PCT Filed: Aug. 28, 2015

(86) PCT No.: PCT/CN2015/088414

§ 371 (c)(1),
(2) Date: Mar. 9, 2016

(87) PCT Pub. No.: WO2016/150101

PCT Pub. Date: Sep. 29, 2016

(65) Prior Publication Data

US 2016/0284270 A1 Sep. 29, 2016

(30) Foreign Application Priority Data

Mar. 26, 2015 (CN) ..... 2015 1 0138231

(51) Int. Cl.
*G09G 3/3233* (2016.01)

(52) U.S. Cl.
CPC ... *G09G 3/3233* (2013.01); *G09G 2300/0819* (2013.01); *G09G 2310/0251* (2013.01); *G09G 2320/045* (2013.01)

(58) Field of Classification Search
CPC ..... G09G 3/3233; G09G 3/3241; G09G 3/325
(Continued)

(56) References Cited

U.S. PATENT DOCUMENTS 6,753,834 B2 * 6/2004 Mikami ..... G09G 3/3258 345/76
7,042,162 B2 * 5/2006 Yamazaki ..... G09G 3/2011 315/169.1

(Continued)

*Primary Examiner* — Alexander Eisen
*Assistant Examiner* — Cory Almeida
(74) *Attorney, Agent, or Firm* — Dilworth & Barrese, LLP.; Michael J. Musella, Esq.

(57) ABSTRACT

An OLED pixel driving circuit, a driving method, and an OLED display apparatus are provided. The OLED pixel driving circuit comprises a reset module (1), a first capacitor (C1), a first transistor (T1), a charging control module (2), a driving transistor (M1) and a light-emitting control module (3); the reset module (1) is connected to two terminals of the first capacitor (C1) and configured to make the two terminals of the first capacitor (C1) have an initial voltage; a first electrode of the first transistor (T1) is connected to the charging control module (2), a second electrode thereof is connected to a first terminal of the first capacitor (C1), and a control electrode thereof is connected to a second terminal of the first capacitor (C1); the charging control module (2) is connected to the first transistor (T1) and a data line (Data); a control electrode of the driving transistor (M1) is connected to the second terminal of the first capacitor (C1), a first electrode thereof is connected to a high voltage terminal (VDD), and a second electrode thereof is connected to the light-emitting control module (3); and the light-emitting control module (3) is connected to the light-emitting device (4), wherein a difference value between a threshold voltage of the first transistor (T1) and a threshold voltage of the driving transistor (M1) is smaller than a preset value. The OLED pixel driving circuit can make the luminance of the OLED pixel within one frame picture maintain stable.

20 Claims, 2 Drawing Sheets

(58) Field of Classification Search
USPC ..... 345/77–83
See application file for complete search history.

(56) References Cited

U.S. PATENT DOCUMENTS

| | | | | |
|---|---|---|---|---|
| 2003/0214469 | A1* | 11/2003 | Kageyama | G09G 3/3233 345/82 |
| 2006/0139253 | A1* | 6/2006 | Choi | G09G 3/3233 345/76 |
| 2007/0139253 | A1* | 6/2007 | Meyers | G01S 7/006 342/57 |
| 2008/0036710 | A1* | 2/2008 | Kim | G09G 3/3233 345/82 |
| 2014/0320473 | A1* | 10/2014 | Ma | G09G 3/3233 345/211 |
| 2015/0269885 | A1* | 9/2015 | Ma | G09G 3/3233 345/205 |
| 2015/0348462 | A1* | 12/2015 | Ma | G09G 3/3225 345/78 |
| 2016/0253959 | A1* | 9/2016 | Sun | G09G 3/2003 345/212 |

* cited by examiner

OLED PIXEL DRIVING CIRCUIT AND DRIVING METHOD AND OLED DISPLAY APPARATUS

TECHNICAL FIELD

The present disclosure relates to an OLED pixel driving circuit, an OLED pixel driving method, and an OLED display apparatus.

BACKGROUND

An active matrix organic light emitting diode (hereinafter referred to as AMOLED) display panel utilizes OLED to emit lights with different luminance, so that pixel display corresponding to OLED has corresponding luminance. Compared with a conventional thin film transistor liquid crystal display panel (TFT LCD), AMOLED display panel has a faster response speed, a higher contrast and a broader angle of view, and is an important development direction of the display panel.

Current that drives OLED to emit light can be represented by the following equation:

$$I_{OLED} = \frac{\beta}{2}(Vgs - Vth)^2$$

where Vgs is a voltage difference between a gate and a source of a driving transistor, β is a parameter related to process parameter and characteristic size of the driving transistor, and Vth is a threshold voltage of the driving transistor.

According to the above equation, the driving current that drives a light-emitting device OLED to emit light is related to the threshold voltage Vth of the driving transistor. In the actual application, the threshold voltage Vth of the driving transistor would change in the light-emitting phase, which would affect light-emitting luminance of the light-emitting device OLED, such that the luminance is non-uniform in the process of light emitting, and then the display effect of the AMOLED display panel would be affected badly.

SUMMARY

There are provided in the present disclosure an OLED pixel driving circuit, an OLED pixel driving method and an OLED display apparatus, which can control the variation amplitude of light-emitting luminance of a light-emitting device within a preset range, so that it is helpful to make luminance of OLED pixel displayed within one frame picture maintain stable.

According to one aspect of the present disclosure, there is provided an OLED pixel driving circuit for driving a light-emitting device in an OELD pixel to emit light, comprising a reset module, a first capacitor, a first transistor, a charging control module, a driving transistor and a light-emitting control module; the reset module is connected to two terminals of the first capacitor and configured to charge the two terminals of the first capacitor, so that the two terminals of the first capacitor have an initial voltage; a first electrode of the first transistor is connected to the charging control module, a second electrode thereof is connected to a first terminal of the first capacitor, and a control electrode thereof is connected to a second terminal of the first capacitor; the charging control module is connected to the first transistor and a data line and configured to control the first transistor to be connected with or disconnected from the data line; a control electrode of the driving transistor is connected to the second terminal of the first capacitor, a first electrode thereof is connected to a high voltage terminal, and a second electrode thereof is connected to the light-emitting control module; the light-emitting control module is connected to the light-emitting device and configured to control the driving transistor to be connected with or disconnected from the light-emitting device, wherein a difference value between a threshold voltage of the first transistor and a threshold voltage of the driving transistor is smaller than a preset value.

Exemplarily, the preset value can be 20 mV.

Alternatively, the threshold voltage of the first transistor and the threshold voltage of the driving transistor can be the same.

Exemplarily, the reset module comprises a second transistor and a third transistor; a control electrode of the second transistor is connected to a reset signal terminal, a first electrode thereof is connected to an input voltage terminal, and a second electrode thereof is connected to the second terminal of the first capacitor; a control electrode of the third transistor is connected to the reset signal terminal, a first electrode thereof is connected to an input voltage terminal, and a second electrode thereof is connected to the first terminal of the first capacitor.

Exemplarily, the charging control module comprises a fifth transistor; a control electrode of the fifth transistor is connected to a gate line, a first electrode thereof is connected to a data line, and a second electrode thereof is connected to the first electrode of the first transistor.

Exemplarily, the light-emitting control module comprises a fourth transistor; a control electrode of the fourth transistor is connected to a light-emitting signal terminal, a first electrode thereof is connected to a second electrode of the driving transistor, and a second electrode thereof is connected to the light-emitting device.

Exemplarily, the OLED pixel driving circuit further comprises a second capacitor, whose first terminal is connected to the high voltage terminal, and second terminal is connected to the second terminal of the first capacitor.

Exemplarily, a voltage of the high voltage terminal is greater than a voltage supplied by the data line.

Exemplarily, the first transistor has a same size and shape as the driving transistor.

Alternatively, the first transistor and the driving transistor are formed through a same composition process.

Exemplarily, respective transistors are P-type transistors.

As another technical solution, there is further provided in the present disclosure an OLED pixel driving method that drives a light-emitting device in an OLED pixel to emit light through an OLED pixel driving circuit, the OLED pixel driving circuit comprising a reset module, a first capacitor, a first transistor, a charging control module, a driving transistor and a light-emitting control module; the OLED pixel driving method comprises following steps:

S1, Two terminals of the first capacitor are charged by the reset module to reset a voltage of the two terminal as an initial voltage;

S2, under the control of the charging control module, a data line charges the first capacitor via the first transistor, to make a voltage of the second terminal of the first capacitor to Vdata+Vth1; the Vdata is a voltage on the data line, and Vth1 is a threshold voltage of the first transistor.

S3, under the control of the light-emitting control module, a driving current is generated according to a voltage of a control electrode and a first electrode of the driving transistor, and the driving transistor is made connected to the light-emitting device, so that the driving current is input to the light-emitting device to make the light-emitting device emit light.

Exemplarily, in step S2, a range of the voltage on the data line is 0.8-1.5V.

Exemplarily, respective transistors are P-type transistors; in step S1, a reset signal terminal is input a low level signal, a gate line is input a high level signal, and a light-emitting signal terminal is input a high level signal; in step S2, the reset signal terminal is input the high level signal, the gate line is input the low level signal, and the light-emitting signal terminal is input the high level signal; in step S3, the reset signal terminal is input the high level signal, the gate line is input the high level signal, and the light-emitting signal terminal is input the low level signal.

According to another aspect of the present disclosure, there is further provided in the present disclosure an OLED display apparatus, comprising the OLED pixel driving circuit provided in the present disclosure.

The OLED pixel driving circuit provided in the present disclosure comprises the first transistor, and charges the first capacitor via the first transistor, to make the voltage of the second terminal of the first capacitor raise to Vdata+Vth1. When the driving current is generated, the driving current can be made related to a difference value between the threshold voltage Vth1 of the first transistor and the threshold voltage Vth2 of the second transistor, and the difference value between the threshold voltage Vth1 of the first transistor and the threshold voltage Vth2 of the driving transistor is smaller than the preset value. In this way, the variation of light-emitting luminance of the light-emitting device can be controlled within the preset range, so as to be helpful to make luminance of OLED pixel displayed within one frame picture maintain stable.

The OLED pixel driving method provided in the present disclosure charges the first capacitor via the first transistor, to make the voltage of the second terminal of the first capacitor raise to Vdata+Vth1. When the driving current is generated, the driving current can be made related to the difference value between the threshold voltage Vth1 of the first transistor and the threshold voltage Vth2 of the second transistor, and the threshold voltage of the first transistor is Vth1, and the difference value between the threshold voltage Vth1 of the first transistor and the threshold voltage Vth2 of the driving transistor is smaller than the preset value. In this way, the variation of light-emitting luminance of the light-emitting device can be controlled within the preset range, so as to be helpful to make luminance of OLED pixel displayed within one frame picture maintain stable.

The OLED display apparatus provided in the present disclosure adopts the OLED pixel driving circuit provided in the present disclosure, can control the variation of light-emitting luminance of the light-emitting device within the preset range, which is helpful to make luminance of OLED pixel displayed within one frame picture maintain stable, so that the display effect can be improved.

DETAILED DESCRIPTION

Specific implementations of the present disclosure will be described below in detail by combining with figures. It should be understood that the specific implementations described herein are just used to describe and explain principles of the present disclosure, but not used to limit the scope of the present disclosure.

The present disclosure provides an implementation of an OLED pixel driving circuit for driving a light-emitting device in an OLED pixel to emit light.

Figure 1:
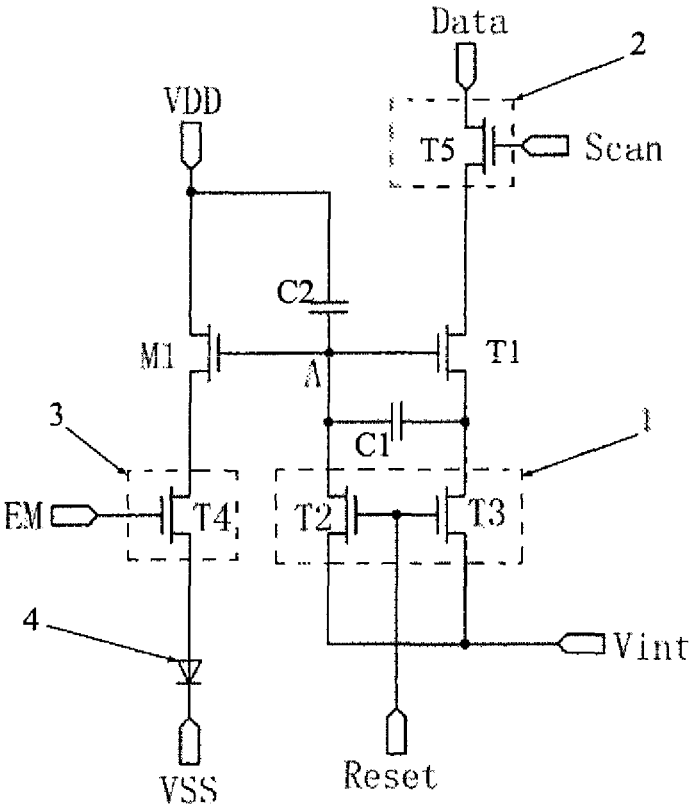
FIG. 1 is a schematic diagram of an OLED pixel driving circuit provided in an implementation of the present disclosure.

FIG. 1 is a schematic diagram of an OLED pixel driving circuit provided in an implementation of the present disclosure. As shown in FIG. 1, in the present implementation, the OLED pixel driving circuit comprises a reset module 1, a first capacitor C1, a first transistor T1, a charging control module 2, a driving transistor M1 and a light-emitting control module 3. The reset module 1 is connected to two terminals of the first capacitor C1, and configured to charge the two terminals of the first capacitor C1, so that the two terminals thereof have an initial voltage. A difference value between a threshold voltage Vth1 of the first transistor T1 and a threshold voltage Vth2 of the driving transistor M1 is smaller than a preset value. A first electrode of the first transistor T1 is connected to the charging control module 2, a second electrode thereof is connected to a first terminal of the first capacitor C1, and a control electrode thereof is connected to a second terminal of the first capacitor C1. The charging control module 2 is connected to the first transistor T1 and the data line Data, and is configured to control the first transistor T1 to be connected with or disconnected from the data line Data. A control electrode of the driving transistor M1 is connected to the second terminal of the first capacitor C1, a first electrode thereof is connected to a high voltage terminal VDD, and a second electrode thereof is connected to the light-emitting control module 3. The light-emitting control module 3 is connected to a light-emitting device 4, and configured to control the driving transistor M1 to be connected with or disconnected from the light-emitting device 4.

In the present implementation, for the first transistor T1, the driving transistor M1 and respective transistors described below, their "control electrodes" are gates, "first electrodes" are sources, and "second electrodes" are drains; of course, it may also be that "first electrodes" are drains, and "second electrodes" are sources.

When the OLED pixel driving circuit provided in the present implementation drives the light-emitting device 4 to emit light, in a first phase, the reset module 1 charges the two terminals of the first capacitor C1 to reset the voltage of the two terminals of the first capacitor C1 as an initial voltage, and the initial voltage is within a voltage range where the first transistor T1 is turned on.

In a second phase, the first transistor T1 is turned on by the initial voltage. At the same time, the charging control module 2 controls the data line Data connected with the first transistor T1. Thus, the data line Data can charge the first capacitor C1 via the first transistor T1. Further, this process can be described as follows: a voltage of the first terminal of the first capacitor C1 rises gradually to Vdata+Vth1, where Vdata is a voltage on the data line, and Vth1 is a threshold voltage of the first transistor T1. In the process that the voltage of the first terminal of the first capacitor C1 rises, due to a bootstrap effect, a voltage of the second terminal of the first capacitor C1 rises gradually, and finally rises to Vdata+Vth1.

In a third phase, a driving current is generated according to a voltage of the control electrode of the driving transistor M1 and a voltage of the first electrode of the same. In particular, the driving current is $I_{OLED}$. It is expressed by the following equation:

$$I_{OLED} = \frac{\beta}{2}(Vgs - Vth)^2 = \frac{\beta}{2}(V\text{data} + Vth1 - VDD - Vth2)^2$$

At the same time, the light-emitting control module 3 controls connection of the driving transistor M1 with the light-emitting device 4. In this way, the driving current is input to the light-emitting device 4, so that the light-emitting device 4 emits light.

It can be known according to the above description, the driving current that drives the light-emitting device 4 to emit light is related to the difference value between the threshold voltage Vth1 of the first transistor T1 and the threshold voltage Vth2 of the driving transistor M1. Since the difference value between Vth1 and Vth2 is smaller than the preset value, in the process of light emitting, the variation of light-emitting luminance of the light-emitting device 4 can be controlled within a preset range, so that it is helpful to make luminance of OLED pixel displayed within one frame picture maintain stable.

In the present implementation, alternatively, the preset value can be 20 mV, that is, a maximum difference value between the threshold Vth1 of the first transistor T1 and the threshold voltage Vth2 of the driving transistor M1 is 20 mV. In this way, in the process of light emitting, the light-emitting luminance of the light-emitting device 4 can be maintained within a relatively stable range. Further, alternatively, the threshold voltage Vth1 of the first transistor T1 is the same as the threshold voltage Vth2 of the driving transistor M1. In this way, the current that drives the light-emitting device 4 to emit light is:

$$I_{OLED} = \frac{\beta}{2}(V\text{data} - VDD)^2$$

Thus, the luminance of the light-emitting device 4 is not affected by the threshold voltage Vth2 of the driving transistor M1 completely, so as to ensure the light-emitting luminance of the light-emitting device 4 to maintain stable.

Exemplarily, the reset module 1 can comprise a second transistor T2, and a third transistor T3. A control electrode of the second transistor T2 is connected to a reset signal terminal Reset, a first electrode thereof is connected to an input voltage terminal Vint, and a second electrode thereof is connected to the second terminal of the first capacitor C1. A control electrode of the third transistor T3 is connected to the reset signal terminal Reset, a first electrode thereof is connected to an input voltage terminal Vint, and a second electrode thereof is connected to the first terminal of the first capacitor C1.

In addition, the charging control module 2 can comprise a fifth transistor T5. A control electrode of the fifth transistor T5 is connected to a gate line Scan, a first electrode thereof is connected to the data line Data, and a second electrode thereof is connected to the first electrode of the first transistor T1.

The light-emitting control module 3 can comprise a fourth transistor T4. A control electrode of the fourth transistor T4 is connected to a light-emitting signal terminal EM, a first electrode thereof is connected to the second electrode of the driving transistor M1, and a second electrode thereof is connected to the light-emitting device 4. The light-emitting device 4 is further connected to a low voltage terminal VSS.

Principle and process that the OLED pixel driving circuit drives the light-emitting device 4 to emit light provided in an implementation will be described in detail below in combination with timings of respective signals by taking respective transistors being P-type transistors as an example.

Figure 2:
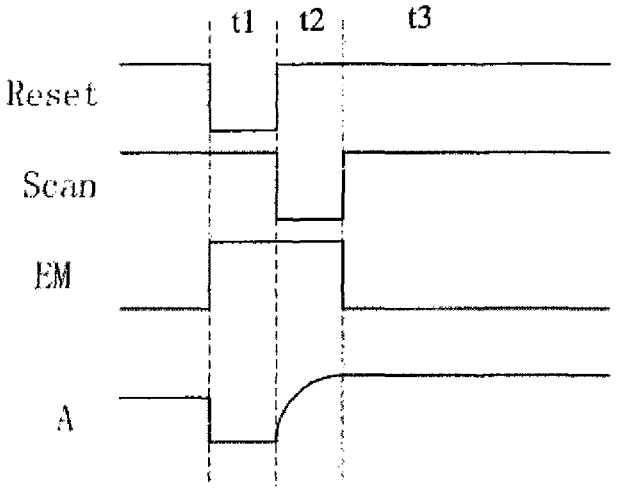
FIG. 2 is timing diagrams of respective signals in an OLED pixel driving circuit when respective transistors in FIG. 1 are P-type transistors.

FIG. 2 shows a timing diagram of respective signals within one period during which the signals drive the light-emitting device 4 to emit light when respective transistors are P-type transistors. As shown in FIG. 2, in a first phase t1 within this period, the reset signal terminal Reset is input a low level signal, so that the second transistor T2 and the third transistor T3 are turned on. When the gate line Scan is input a high level signal, the fifth transistor T5 is turned off. When the light-emitting signal terminal EM is input the high level signal, the fourth transistor T4 is turned on. In the case that the second transistor T2 and the third transistor T3 are turned on, the input signal terminal Vint charges the two terminals of the first capacitor C1 via the second transistor T2 and the third transistor T3 respectively, to reset the voltage of the two terminals of the first capacitor C1 as the initial voltage.

In a second phase t2, the reset signal terminal Reset is input a high level signal, so that the second transistor T2 and the third transistor T3 are turned off. When the gate line Scan is input the low level signal, the fifth transistor T5 is turned on. The light-emitting signal terminal EM is still input the high level signal, so that the fourth transistor T4 is turned off. In the case that the fifth transistor T5 is turned on, the data line Data charges the first capacitor C1 via the fifth transistor T5 and the first transistor T1, so that the voltage of the first terminal of the first capacitor C1 rises to Vdata+Vth1 gradually. It can be understood that, due to the bootstrap effect, the voltage of the second terminal of the first capacitor C1, i.e., the voltage of node A in FIG. 1, would also rise to Vdata+Vth1 gradually, as shown in FIG. 2.

In a third phase t3, the reset signal terminal Reset is input the high level signal, so that the second transistor T2 and the third transistor T3 are turned off. The gate line Scan is input the high level signal, so that the fifth transistor T5 is turned off. The light-emitting signal terminal EM is input the low level signal, so that the fourth transistor T4 is turned on. In the case that the fourth transistor T4 is turned on, the driving current generated according to the voltage of the control electrode of the driving transistor M1 and the voltage of the first electrode of the same can be input to the light-emitting device 4 via the fourth transistor T4, to drive the light-emitting device 4 to emit light. Furthermore, the driving current $I_{OLED}$ can be represented as follows:

$$I_{OLED} = \frac{\beta}{2}(Vgs - Vth1)^2 = \frac{\beta}{2}(V\text{data} + Vth1 - VDD - Vth2)^2$$

According to the above equation, it can be known that the driving current is related to the difference value between the threshold voltage Vth1 of the first transistor T1 and the threshold voltage Vth2 of the driving transistor M1, and the difference value of Vth1 and Vth2 can be set smaller than the preset value. Therefore, in the process of light emitting, the value of the driving current $I_{OLED}$ can be controlled within the preset range. That is, the variation range of light-emitting luminance of the light-emitting device 4 within one period can be controlled within the preset range, so as to be helpful to make luminance of OLED pixel displayed within one frame picture maintain stable.

From the above, it can be known that in the third phase t3, the first terminal of the first capacitor C1 is in a floating state. In this state, charges stored in the first capacitor C1 would lose easily, which results in change of voltage of the node A.

Alternatively, as shown in FIG. 1, the OLED pixel driving circuit can further comprise a second capacitor C2. A first terminal of the second capacitor C2 is connected to a high voltage terminal VDD, a second terminal thereof is connected to the second terminal of the first capacitor C1. The second capacitor C2 is connected to the second terminal of the first capacitor C1 to be able to prevent the voltage of the node A from changing due to floating of the first terminal of the first capacitor C1, so as to avoid the driving current that drives the light-emitting device 4 to emit light from being instable.

In the present implementation, alternatively, the voltage of the high voltage terminal VDD can be greater than the voltage Vdata provided by the data line Data. In this case, the driving current $I_{OLED}$ can drive the light-emitting device 4 to emit light. When VDD is smaller than Vdata, the driving current $I_{OLED}$ cannot drive the light-emitting device 4 to emit light. In general, the range of the voltage Vdata provided by the data line Data is 0.8-1.5V.

Alternatively, the first transistor T1 may have a same size and shape as the driving transistor M1, to ensure that the threshold voltage Vth1 of the first transistor T1 and the threshold voltage Vth2 of the driving transistor M1 are equal. Further, the first transistor T1 and the driving transistor M1 are formed through a same composition process. Such setting can also reduce the number of the composition processes, decrease the cost, and raise production efficiency.

It should be noted that in the present implementation, the respective transistors are not limited to the P-type transistor. In actual application, the respective transistors can also be N-type transistors. It can be understood that the timing of respective signals is opposite to the timing of respective signals as shown in FIG. 2 when the respective transistors are N-type transistors.

The OLED pixel driving circuit provided in the implementation of the present disclosure comprises a first transistor T1, and charges the first capacitor C1 via the first transistor T1, so that the voltage of the gate of the driving transistor M1 connected to the first capacitor C1 comprises the threshold voltage Vth1. As a result, the driving current generated according to the voltages of the control electrode and first electrode of the driving transistor M1 is related to the difference value between the threshold voltage Vth1 of the first transistor T1 and the threshold voltage Vth2 of the driving transistor M1, while the difference value between the threshold voltage Vth1 of the first transistor T1 and the threshold voltage Vth2 of the driving transistor M1 is smaller than the preset value. In this way, the variation of light-emitting luminance of the light-emitting device 4 within one period can be controlled within the preset range, to facilitate making the luminance of OLED pixel displayed within one frame picture maintain stable.

The present disclosure further provides an implementation of an OLED pixel driving method. The OLED pixel driving method drives a light-emitting device in the OLED pixel to emit light based on the OLED pixel driving circuit provided in the implementation of the present disclosure.

Figure 3:
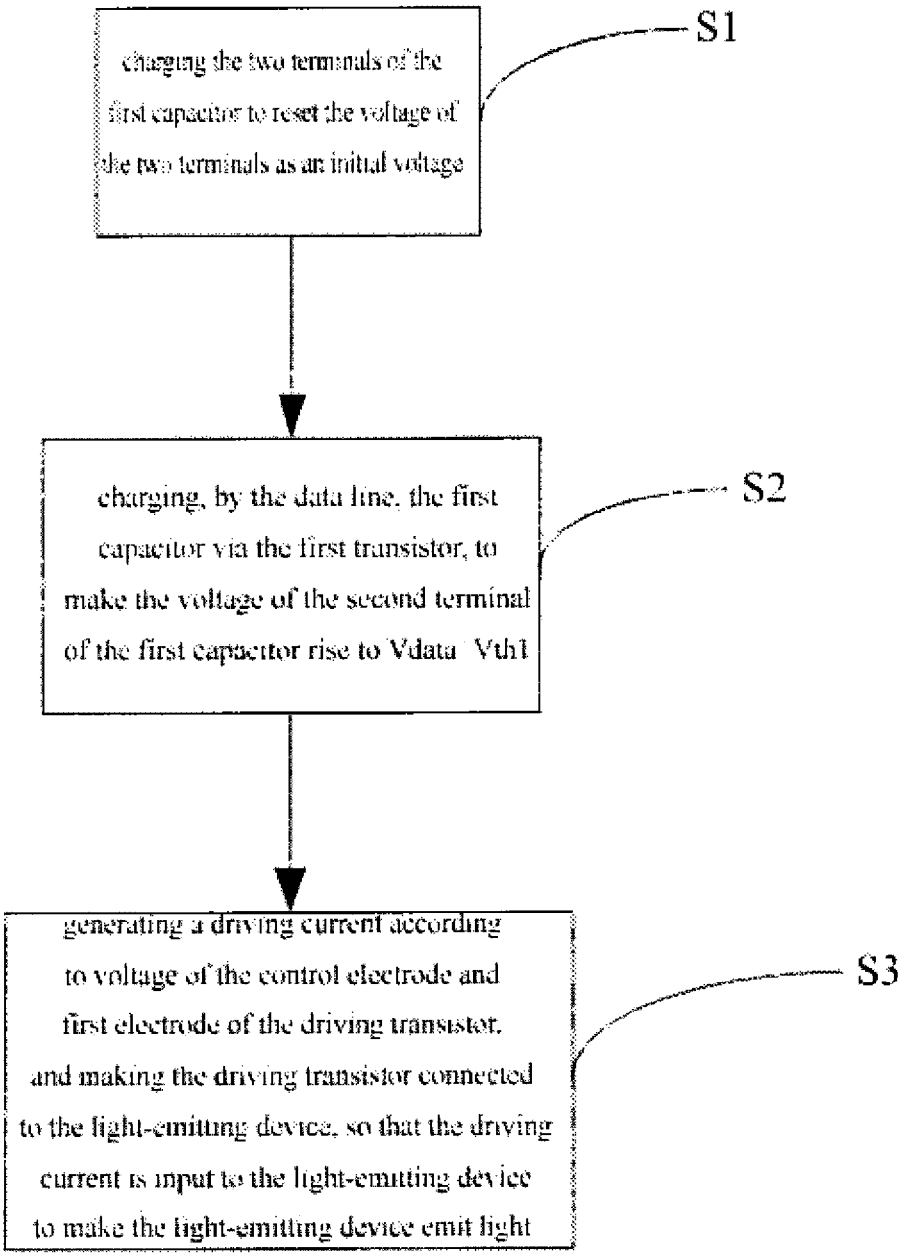
FIG. 3 is a flow diagram of an OLED pixel driving method provided in an implementation of the present disclosure.

FIG. 3 is a flow diagram of an OLED pixel driving method provided in an implementation of the present disclosure. As shown in FIG. 3, the OLED pixel driving method comprises following processes:

In step S1, the two terminals of the first capacitor are charged to reset the voltage of the two terminals as an initial voltage.

Herein, the initial voltage falls into a voltage range of turning on the first transistor T1. When the second terminal of the first capacitor has the initial voltage, the first transistor whose control electrode is connected to the second terminal of the first capacitor is turned on.

Exemplarily, in step S1, when respective transistors are P-type transistors, a reset signal terminal is input a low level signal, a gate line is input a high level signal, and a light-emitting signal terminal is input a high level signal.

In step S2, a data line charges the first capacitor via the first transistor, such that the voltage of the second terminal of the first capacitor raises to Vdata+Vth1, wherein Vdata is the voltage on the data line, and Vth1 is the threshold voltage of the first transistor.

Exemplarily, when the voltage of the second terminal of the first capacitor raises to Vdata+Vth1, the voltage of the control electrode of the first transistor connected to the second terminal of the first capacitor is Vdata+Vth1.

In step S2, when the respective transistors are P-type transistors, the reset signal terminal is input the high level signal, the gate line is input the low level signal, and the light-emitting signal terminal is input the high level signal.

In step S3, a driving current is generated according to voltages of the control electrode and the first electrode of the driving transistor, and the driving transistor is connected to the light-emitting device, so that the driving current is input to the light-emitting device to make the light-emitting device emit light.

Exemplarily, in step S3, when the respective transistors are P-type transistors, the reset signal terminal is input the high level signal, the gate line is input the high level signal, and the light-emitting signal terminal is input the low level signal.

In the case that the voltage of the control electrode of the first transistor is Vdata+Vth1, the generated driving current $I_{OLED}$ is related to the difference value between the threshold voltage of the first transistor and the threshold voltage of the driving transistor (the specific value of the driving current $I_{OLED}$ has already been described in the implementation of the OLED pixel driving circuit, and thus no further description is given herein). By making the difference value between the two threshold voltages smaller than the preset value, the variation range of light-emitting luminance of the light-emitting device would be controlled within the preset range, so that it is helpful to make luminance of the OLED pixel displayed within one frame picture maintain stable.

Alternatively, in step S2, the range of the voltage on the data line would be 0.8-1.5V.

The OLED pixel driving method provided in the implementation of the present disclosure charges the first capacitor via the first transistor, so that the voltage of the second terminal of the first capacitor raises to Vdata+Vth1. When the driving current is generated, the driving current is related to the difference value between the threshold voltage of the first transistor and the threshold voltage Vth of the driving transistor. Furthermore, by making the difference value between the threshold voltage of the first transistor and the threshold voltage of the driving transistor smaller than the preset value, the variation amplitude of light-emitting luminance of the light-emitting device would be controlled within the preset range, so that it is helpful to make luminance of the OLED pixel displayed within one frame picture maintain stable.

The present disclosure further provides an implementation of an OLED display apparatus. In the present implementation, the OLED display apparatus comprises the OLED pixel driving circuit provided in the implementation of the present disclosure.

The OLED display apparatus provided in the implementation of the present disclosure adopts the OLED pixel driving circuit provided in the implementation of the present disclosure to be able to control the light-emitting luminance of the light-emitting device within the preset range, which is helpful to make the luminance of the OLED pixel displayed within one frame picture maintain stable, so that the display effect can be raised.

It can be understood that the above implementation is just an exemplary implementation used to describe the principle of the present disclosure. However, the present disclosure is not limited thereto. For those ordinary skilled in the art, various modifications and improvements can be made, without departing from the spirit and substance of the present disclosure. These modifications and improvements are deemed as falling into the protection scope of the present disclosure. The protection scope of the present disclosure is defined by the Claims.

The present application claims the priority of a Chinese patent application No. 201510138231.3 filed on Mar. 26, 2015. Herein, the content disclosed by the Chinese patent application is incorporated in full by reference as a part of the present disclosure.

What is claimed is:

1. An OLED pixel driving circuit for driving a light-emitting device in an OELD pixel to emit light, wherein the OLED pixel driving circuit comprises a reset module, a first capacitor, a first transistor, a charging control module, a driving transistor and a light-emitting control module;

the reset module is connected to two terminals of the first capacitor and configured to charge the two terminals of the first capacitor, so that the two terminals of the first capacitor have an initial voltage;

a first electrode of the first transistor is connected to the charging control module, a second electrode thereof is connected to a first terminal of the first capacitor, and a control electrode is connected to a second terminal of the first capacitor;

the charging control module is connected to the first transistor and a data line and configured to control the first transistor to be connected with or disconnected from the data line;

a control electrode of the driving transistor is connected to the second terminal of the first capacitor, a first electrode thereof is connected to a high voltage terminal, and a second electrode thereof is connected to the light-emitting control module; and the light-emitting control module is connected to the light-emitting device and configured to control the driving transistor to be connected with or disconnected from the light-emitting device, wherein a difference value between a threshold voltage of the first transistor and a threshold voltage of the driving transistor is smaller than a preset value.

2. The OLED pixel driving circuit according to claim 1, wherein the reset module comprises a second transistor and a third transistor;

a control electrode of the second transistor is connected to a reset signal terminal, a first electrode thereof is connected to an input voltage terminal, and a second electrode thereof is connected to the second terminal of the first capacitor; and a control electrode of the third transistor is connected to the reset signal terminal, a first electrode thereof is connected to an input voltage terminal, and a second electrode thereof is connected to the first terminal of the first capacitor.

3. The OLED pixel driving circuit according to claim 2, wherein the charging control module comprises a fifth transistor;

a control electrode of the fifth transistor is connected to a gate line, a first electrode thereof is connected to a data line, and a second electrode thereof is connected to the first electrode of the first transistor.

4. The OLED pixel driving circuit according to claim 3, wherein the light-emitting control module comprises a fourth transistor;

a control electrode of the fourth transistor is connected to a light-emitting signal terminal, a first electrode thereof is connected to a second electrode of the driving transistor, and a second electrode thereof is connected to the light-emitting device.

5. The OLED pixel driving circuit according to claim 4, wherein respective transistors are P-type transistors.

6. The OLED pixel driving circuit according to claim 3, wherein the first transistor has a same size and shape as the driving transistor.

7. The OLED pixel driving circuit according to claim 1, wherein the OLED pixel driving circuit further comprises a second capacitor, whose first terminal is connected to the high voltage terminal, and second terminal is connected to the second terminal of the first capacitor.

8. The OLED pixel driving circuit according to claim 1, wherein a voltage of the high voltage terminal is greater than a voltage supplied by the data line.

9. The OLED pixel driving circuit according claim 1, wherein the first transistor and the driving transistor are formed through a same composition process.

10. The OLED pixel driving circuit according to claim 1, wherein the preset value is 20 mV.

11. The OLED pixel driving circuit according to claim 1, wherein the threshold voltage of the first transistor is the same as the threshold voltage of the driving transistor.

12. An OLED pixel driving method that drives a light-emitting device in OLED pixel to emit light through an OLED pixel driving circuit according to claim 1, the OLED pixel driving method comprises following steps:

S1, charging two terminals of the first capacitor by the reset module to reset a voltage of the two terminals as an initial voltage;

S2, charging the first capacitor via the first transistor by a data line, under the control of the charging control module, to make a voltage of the second terminal of the first capacitor rise to Vdata+Vth1; the Vdata being a voltage on the data line, and Vth1 being a threshold voltage of the first transistor; and S3, generating a driving current according to voltages of a control electrode and a first electrode of the driving transistor, under the control of the light-emitting control module, and making the driving transistor connected to the light-emitting device, so that the driving current is input to the light-emitting device to make the light-emitting device emit light.

13. The OLED pixel driving method according to claim 12, wherein in step S2, a range of the voltage on the data line is 0.8-1.5V.

14. The OLED pixel driving method according to claim 12, wherein respective transistors in the OLED pixel driving circuit are P-type transistors;

in step S1, inputting a low level signal to a reset signal terminal, inputting a high level signal to a gate line, and inputting a high level signal to a light-emitting signal terminal;

in step S2, inputting the high level signal to the reset signal terminal, inputting the low level signal to the gate line, and inputting the high level signal the light-emitting signal terminal; and in step S3, inputting the high level signal to the reset signal terminal, inputting the high level signal to the gate line, and inputting the low level signal to the light-emitting signal terminal.

15. An OLED display apparatus, comprising the OLED pixel driving circuit according to claim 1.

16. The OLED display apparatus according to claim 15, wherein the reset module comprises a second transistor and a third transistor;

a control electrode of the second transistor is connected to a reset signal terminal, a first electrode thereof is connected to an input voltage terminal, and a second electrode thereof is connected to the second terminal of the first capacitor; and a control electrode of the third transistor is connected to the reset signal terminal, a first electrode thereof is connected to an input voltage terminal, and a second electrode thereof is connected to the first terminal of the first capacitor.

17. The OLED display apparatus according to claim 16, wherein the charging control module comprises a fifth transistor;

a control electrode of the fifth transistor is connected to a gate line, a first electrode thereof is connected to a data line, and a second electrode thereof is connected to the first electrode of the first transistor.

18. The OLED display apparatus according to claim 17, wherein the light-emitting control module comprises a fourth transistor;

a control electrode of the fourth transistor is connected to a light-emitting signal terminal, a first electrode thereof is connected to a second electrode of the driving transistor, and a second electrode thereof is connected to the light-emitting device.

19. The OLED display apparatus according to claim 15, wherein the OLED pixel driving circuit further comprises a second capacitor, whose first terminal is connected to the high voltage terminal, and second terminal is connected to the second terminal of the first capacitor.

20. The OLED display apparatus according to claim 15, wherein a voltage of the high voltage terminal is greater than a voltage supplied by the data line.

* * * * *